US010036395B2

(12) United States Patent
Takeda et al.

(10) Patent No.: US 10,036,395 B2
(45) Date of Patent: Jul. 31, 2018

(54) COMPRESSOR CONTROL DEVICE AND CONTROL METHOD THEREFOR, AND COMPRESSOR SYSTEM

(71) Applicants: MITSUBISHI HEAVY INDUSTRIES, LTD., Tokyo (JP); MITSUBISHI HEAVY INDUSTRIES COMPRESSOR CORPORATION, Tokyo (JP)

(72) Inventors: Kazuhiro Takeda, Tokyo (JP); Yosuke Nakagawa, Tokyo (JP); Hiroyuki Miyata, Hiroshima (JP); Naoki Mori, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 513 days.

(21) Appl. No.: 14/373,429

(22) PCT Filed: Feb. 20, 2013

(86) PCT No.: PCT/JP2013/054221
§ 371 (c)(1),
(2) Date: Jul. 21, 2014

(87) PCT Pub. No.: WO2013/125597
PCT Pub. Date: Aug. 29, 2013

(65) Prior Publication Data

US 2014/0363269 A1 Dec. 11, 2014

(30) Foreign Application Priority Data

Feb. 23, 2012 (JP) ..... 2012-037335

(51) Int. Cl.
*F04D 27/00* (2006.01)
*F04D 27/02* (2006.01)
*F04B 41/06* (2006.01)

(52) U.S. Cl.
CPC ..... *F04D 27/002* (2013.01); *F04B 41/06* (2013.01); *F04D 27/009* (2013.01);
(Continued)

(58) Field of Classification Search
CPC .... F04D 27/002; F04D 27/003; F04D 27/005; F04D 27/009; F04D 27/0207;
(Continued)

(56) References Cited

U.S. PATENT DOCUMENTS 3,715,887 A * 2/1973 Weatherly ..... C01B 21/26 422/510
5,306,116 A * 4/1994 Gunn ..... F04D 27/02 415/17

(Continued)

FOREIGN PATENT DOCUMENTS

CN 102072186 5/2011
JP 61-201900 9/1986

(Continued)

OTHER PUBLICATIONS

Extended European Search Report dated Sep. 18, 2015 in corresponding European Patent Application No. 13752272.8.

(Continued)

*Primary Examiner* — Jason Shanske
*Assistant Examiner* — Alexander White
(74) *Attorney, Agent, or Firm* — Wenderoth, Lind & Ponack, L.L.P.

(57) ABSTRACT

A compressor control device includes an inlet guide vane opening degree control unit configured to control an opening degree of an inlet guide vane. The inlet guide vane opening (Continued)

degree control unit includes an inlet guide vane opening degree command value calculation unit configured to calculate an inlet guide vane opening degree command value based on an outlet pressure detection value and a plurality of inlet guide vane opening degree correction units each configured to correct the inlet guide vane opening degree command value based on the post-merger pressure detection value and a corresponding inlet flow rate detection value for each of a plurality of upstream-most compressor bodies.

8 Claims, 9 Drawing Sheets

(52) U.S. Cl.
CPC ..... *F04D 27/0223* (2013.01); *F04D 27/0246* (2013.01); *F04D 27/0269* (2013.01)

(58) Field of Classification Search
CPC ..... F04D 27/0223; F04D 27/0246; F04D 27/0269; F04B 41/06; F01D 17/02; F01D 17/08; F01D 17/14; F01D 17/141; F01D 17/143; F01D 17/145; F01D 17/16; F01D 17/162; F01D 17/165; F01D 17/167
See application file for complete search history.

(56) References Cited

U.S. PATENT DOCUMENTS 5,347,467 A * 9/1994 Staroselsky ..... F04D 27/0269 415/1
7,422,414 B2 * 9/2008 Fujii ..... F02C 9/20 415/1
2012/0215417 A1 * 8/2012 Boyer ..... F01D 17/162 701/100

FOREIGN PATENT DOCUMENTS

| | | |
|---|---|---|
| JP | 06-088597 | 3/1994 |
| JP | 2008-75477 | 4/2008 |
| JP | 2011-111950 | 6/2011 |
| WO | 2011/023690 | 3/2011 |

OTHER PUBLICATIONS

Chinese Office Action dated Oct. 9, 2015 in corresponding Chinese Patent Application No. 201380007137.3 with partial English Translation.
International Search Report dated May 28, 2013 in International (PCT) Application No. PCT/JP2013/054221 with English Translation.
Japanese Notice of Allowance dated Aug. 5, 2014 in corresponding Japanese Patent Application No. 2012-037335 with English Translation.
Written Opinion of the International Searching Authority dated May 28, 2013 in International (PCT) Application No. PCT/JP2013/054221 with English Translation.
Decision to grant a European Patent pursuant to Article 97(1) EPC dated Aug. 25, 2016 in corresponding European Application No. 13752272.8.

* cited by examiner $F3=F1\times\alpha+F2\times(1-\alpha)$

COMPRESSOR CONTROL DEVICE AND CONTROL METHOD THEREFOR, AND COMPRESSOR SYSTEM

TECHNICAL FIELD

The present invention relates to a compressor control device and a control method therefor, and a compressor system in which a plurality of compressor bodies are provided.

Priority is claimed on Japanese Patent Application No. 2012-037335, filed Feb. 23, 2012, the content of which is incorporated herein by reference.

BACKGROUND ART

Compressors that compress gases and supply the compressed gases to machines or the like connected downstream have been known. As the compressors, there is a compressor in which an inlet guide vane is disposed upstream and a gas is caused to flow in from an inlet to a compressor body via the inlet guide vane. By adjusting an opening degree of the inlet guide vane, a flow rate of the gas flowing in the compressor body is controlled.

In such a compressor, compressor bodies on a plurality of stages are provided from the upstream side of flow of a gas to the downstream side thereof in some cases (for example, see Patent Literature 1). There is also a compressor in which, to increase a flow rate, a plurality of compressor bodies are provided furthest upstream, gases compressed by the plurality of compressor bodies are merged, and subsequently the merged gases are caused to flow in a compressor body located downstream. In such a compressor, there is a control method of controlling the state of a discharged gas by controlling opening degrees of inlet guide vanes provided in the inlets of the plurality of compressor bodies located furthest upstream in a synchronized manner.

CITATION LIST

Patent Literature

[Patent Literature 1]
Japanese Unexamined Patent Application, First Publication No. H06-88597

SUMMARY OF INVENTION

In such a control method, however, a difference in performance may occur due to an individual difference or aging degradation between the plurality of compressor bodies provided furthest upstream in some cases. In these cases, since the opening degrees of the inlet guide vanes of the other compressor bodies are also controlled based on the performance of the compressor body with degraded performance, there is a probability of an operable range being narrowed.

An object of the present invention is to provide a compressor control device and a control method therefor, and a compressor system capable of performing optimum working by properly controlling opening degrees of inlet guide vanes even when a difference in performance occurs in a plurality of compressor bodies.

(1) According to a first aspect of the present invention, there is provided a compressor control device controlling a compressor that includes a plurality of upstream-most compressor bodies disposed furthest upstream, at least one stage of downstream compressor body which is disposed downstream from the plurality of upstream-most compressor bodies and in which a gas merged after outflow of gases from the plurality of upstream-most compressor bodies flows, an inlet guide vane provided in the vicinity of an inlet of each of the plurality of upstream-most compressor bodies and configured to control a flow rate of the gas flowing in the corresponding upstream-most compressor body, a plurality of upstream-most flow rate detectors provided in the vicinity of the inlets or outlets of the plurality of upstream-most compressor bodies and configured to generate upstream-most flow rate detection values by detecting flow rates flowing through the corresponding upstream-most compressor bodies, a post-merger pressure detector configured to generate a post-merger pressure detection value by detecting a post-merger pressure of the gas flowing out from each of the plurality of upstream-most compressor bodies, and an outlet pressure detector configured to generate an outlet pressure detection value by detecting an outlet pressure of a downstream-most compressor body disposed furthest downstream among the downstream compressor bodies. The compressor control device includes an inlet guide vane opening degree control unit configured to control an opening degree of the inlet guide vane. The inlet guide vane opening degree control unit includes an inlet guide vane opening degree command value generation unit configured to generate an inlet guide vane opening degree command value from the outlet pressure detection value and a plurality of inlet guide vane opening degree command value correction units configured to correct the inlet guide vane opening degree command value based on the post-merger pressure detection value and the corresponding upstream-most flow rate detection value in each of the plurality of upstream-most compressor bodies.

According to the first aspect of the present invention, with regard to the opening degree of the inlet guide vane provided in each of the plurality of upstream-most compressor bodies, the inlet guide vane opening degree command value can be corrected based on the corresponding upstream-most flow rate detection value and the post-merger pressure detection value. Thus, the opening degrees of the respective inlet guide vanes can be controlled in consideration of the difference in performance in the plurality of upstream-most compressor bodies.

(2) In the compressor control device described in the foregoing (I), the inlet guide vane opening degree command value correction unit may generate an inlet guide vane opening degree correction value by dividing the upstream-most flow rate detection value by the post-merger pressure detection value and correct the inlet guide vane opening degree command value based on the inlet guide vane opening degree command correction value.

In this configuration, the inlet guide vane opening degree command value can be corrected based on each working state of the plurality of upstream-most compressor bodies. Thus, the opening degrees of the respective inlet guide vanes can be controlled in consideration of the difference in performance between the plurality of upstream-most compressor bodies, thereby preventing so-called surging from occurring.

(3) In the compressor control device described in the foregoing (1), the inlet guide vane opening degree command value correction unit may generate a flow rate estimation value based on the post-merger pressure detection value and an inlet guide vane opening degree detection value generated by an inlet guide vane opening degree detector included in the compressor to detect an opening degree of the inlet guide vane, generate an inlet guide vane opening degree command correction value based on a difference between the flow rate estimation value and the upstream-most flow rate detection value, and correct the inlet guide vane opening degree command value based on the inlet guide vane opening degree command correction value.

In this configuration, even when the performance of the plurality of upstream-most compressor bodies differs from the initial performance thereof, appropriate correction can be performed based on estimated flow rates.

(4) In the compressor control device described in any one of the foregoing (1) to (3), the inlet guide vane opening degree command value correction unit may include a correction cancellation signal generation unit configured to output a signal to cancel the inlet guide vane opening degree correction value.

In this configuration, when the inlet guide vane opening degree command value need not be corrected due to the difference in the performance between the plurality of upstream-most compressor bodies, e.g., when an alarm occurs, whether the correction is performed can be switched.

(5) In the compressor control device described in any one of the foregoing (1) to (4), the inlet guide vane opening degree command value correction unit may include a performance difference correction coefficient generation unit configured to generate a performance difference correction coefficient indicating a difference in performance between the plurality of upstream-most compressor bodies and an inlet flow rate target value generation unit configured to calculate an inlet flow rate target value based on the performance difference correction coefficient and the upstream-most flow rate detection value of each of the plurality of upstream-most compressor bodies, and may calculate an inlet guide vane opening degree command correction value based on the inlet flow rate target value and the upstream-most flow rate detection value.

In this configuration, the inlet guide vane opening degree command value can be corrected based on a coefficient input in advance and indicating the difference in the performance between the plurality of upstream-most compressor bodies. Thus, a correction amount by the difference in the performance between the plurality of upstream-most compressor bodies can be adjusted depending on the situation.

(6) The compressor control device described in any one of the foregoing (1) to (5) may further include a blowoff valve opening degree control unit configured to control an opening degree of a blowoff valve provided in the vicinity of the outlet of the downstream-most compressor body. The blowoff valve opening degree control unit may include an upstream anti-surge control unit configured to calculate a first blowoff valve opening degree command value based on the upstream-most flow rate detection value and the post-merger pressure detection value, an outlet pressure control unit configured to calculate a second blowoff valve opening degree command value based on the outlet pressure detection value, a downstream anti-surge control unit configured to calculate a third blowoff valve opening degree command value based on an outlet flow rate detection value and an outlet pressure detection value detected by an outlet flow rate detector provided in the vicinity of an outlet of the downstream-most compressor body, and a command value selection unit configured to control a blowoff valve opening degree by selecting a command value by which the blowoff valve opening degree is the largest among the first blowoff valve opening degree command value, the second blowoff valve opening degree command value, and the third blowoff valve opening degree command value.

In this configuration, it is possible to control the opening degree of the blowoff valve in consideration of surging in the upstream-most compressor body. Thus, it is possible to prevent surging from occurring in the upstream-most compressor body.

(7) In the compressor control device described in the foregoing (6), the upstream anti-surge control unit may calculate an inlet flow rate target value based on the post-merger pressure detection value and output the first blowoff valve opening degree command value by which the blowoff valve opening degree is controlled such that a flow rate in the inlet of the upstream-most compressor body becomes the inlet flow rate target value.

In this configuration, it is possible to control the opening degree of the blowoff valve so that a flow rate in the inlet of the upstream-most compressor body becomes the inlet flow rate target value. Thus, it is possible to prevent surging from occurring in the upstream-most compressor body.

(8) In the compressor control device described in the foregoing (6) or (7), the command value selection unit may be a low selector configured to select the smallest value among the first blowoff valve opening degree command value, the second blowoff valve opening degree command value, and the third blowoff valve opening degree command value.

In this configuration, the blowoff valve opening degree command value is expressed as a value, i.e., the smaller the value is, the larger the opening degree of the blowoff valve is, and the smallest value is selected by the low selector. Thus, even when there is no signal of the blowoff valve opening degree command value, it is possible to control the opening degree of the blowoff safely against surging.

(9) According to a second aspect of the present invention, there is provided a compressor system including the compressor control device described in any one of the foregoing (1) to (8) and the compressor controlled by the compressor control device.

In this configuration, it is possible to provide the compressor system obtaining the operational advantageous effects described above.

(10) According to a third aspect of the present invention, there is provided a compressor control method of controlling a compressor that includes a plurality of upstream-most compressor bodies disposed furthest upstream, an at least one stage of downstream compressor body which is disposed downstream from the plurality of upstream-most compressor bodies and in which a gas merged after outflow of gases from the plurality of upstream-most compressor bodies flows, an inlet guide vane provided in the vicinity of an inlet of each of the plurality of upstream-most compressor bodies and configured to control the flow rate of the gas flowing in the corresponding upstream-most compressor body, a plurality of upstream-most flow rate detectors provided in the vicinity of the inlets of the plurality of upstream-most compressor bodies and configured to generate upstream-most flow rate detection values by detecting inlet flow rates of the corresponding upstream-most compressor bodies, a post-merger pressure detector configured to generate a post-merger pressure detection value by detecting a post-merger pressure of the gas flowing out from each of the plurality of upstream-most compressor bodies, and an outlet pressure detector configured to generate an outlet pressure detection value by detecting an outlet pressure of a downstream-most compressor body disposed furthest downstream among the downstream compressor bodies. The compressor control method includes: generating an inlet guide vane opening degree command value based on the outlet pressure detection value in an inlet guide vane opening degree control unit controlling an opening degree of the inlet guide vane; and correcting the inlet guide vane opening degree command value based on the post-merger pressure detection value and the corresponding upstream-most flow rate detection value in each of the plurality of upstream-most compressor bodies.

In this configuration, with regard to the opening degree of the inlet guide vane provided in each of the plurality of upstream-most compressor bodies, the inlet guide vane opening degree command value can be corrected based on the corresponding upstream-most flow rate detection value and the post-merger pressure detection value. Thus, the opening degrees of the respective inlet guide vanes can be controlled in consideration of the difference in performance between the plurality of upstream-most compressor bodies.

In the compressor control device and the control method therefor, and the compressor system according to each aspect of the present invention, it is possible to perform optimum working even when a difference in performance occurs between the plurality of compressor bodies, as described above.

DESCRIPTION OF EMBODIMENTS

Figure 1:
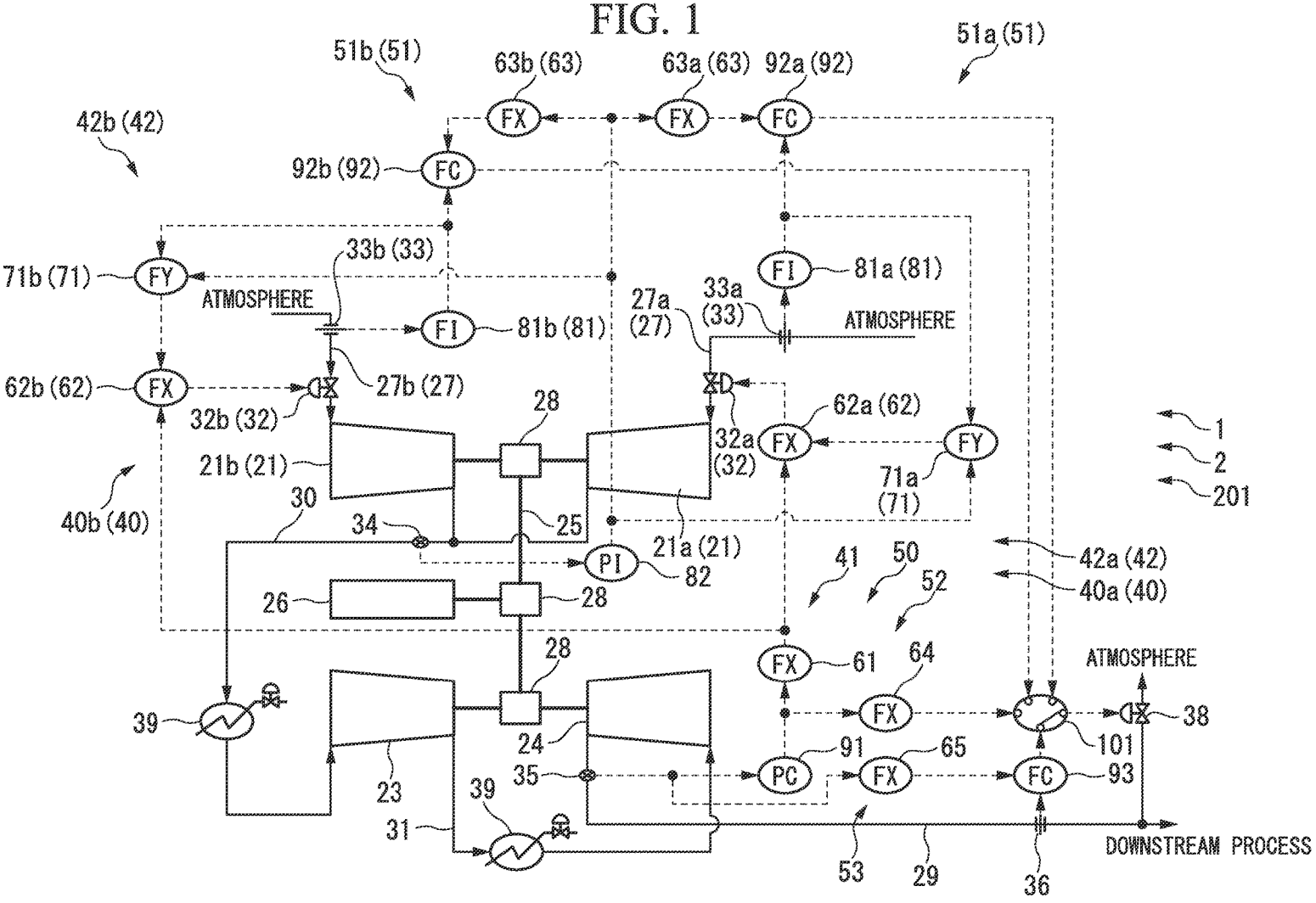
FIG. 1 is a diagram showing the configuration of a compressor system according to a first embodiment of the present invention.

Hereinafter, a first embodiment of the present invention will be described with reference to the drawings. FIG. 1 illustrates a compressor system 1 according to the first embodiment of the present invention. The compressor system 1 is configured to include a compressor 2 and a compressor control device 201. The compressor 2 is configured to include a plurality of compressor bodies. In the compressor system 1, the compressor bodies are provided on a plurality of stages from the upstream side of a flow of a gas (including air) to the downstream side thereof. Upstream-most compressor bodies 21 disposed furthest upstream include two compressor bodies (a first upstream-most compressor body 21*a* and a second upstream-most compressor body 21*b*) provided in parallel. Downstream compressor bodies are provided on two stages downstream from the upstream-most compressor bodies 21. In the embodiment, the downstream compressor bodies include a downstream-most compressor body 24 provided furthest downstream and an intermediate compressor body 23 provided in the middle of the upstream-most compressor bodies 21 and the downstream-most compressor body 24.

Each compressor body is connected to a motor 26 serving as a driving source through a shaft 25. On one end of the shaft 25, the plurality of upstream-most compressor bodies 21 are disposed in parallel on the shaft 25. Further, on the other end of the shaft 25, the intermediate compressor body 23 and the downstream-most compressor body 24 are disposed in parallel on the shaft 25. The motor 26 is connected to the middle of the shaft 25. Each compressor body and the motor 26 are connected to the shaft 25 through a gearbox 28.

In the outlet of each of the plurality of upstream-most compressor bodies 21, a compressed gas is generated by compressing a gas which is sucked in the plurality of upstream-most compressor bodies 21 through a supply line 27. The supply lines 27 include a first supply line 27*a* and a second supply line 27*b* and are pipes through which gases are supplied to the upstream-most compressor bodies 21. The first supply line 27*a* is connected to the inlet of the first upstream-most compressor body 21*a* and the second supply line 27*b* is connected to the inlet of the second upstream-most compressor body 21*b*.

A first connection line 30 is connected to the outlet of each of the plurality of upstream-most compressor bodies 21. The first connection line 30 is connected to the inlet of the intermediate compressor body 23. The first connection line 30 is a pipe through which the compressed gas generated by the upstream-most compressor bodies 21 is supplied to the intermediate compressor body 23. The first connection line 30 has a merging portion, and thus merges the compressed gases discharged from the first upstream-most compressor body 21*a* and the second upstream-most compressor body 21*b* and then supplies the merged compressed gas to the intermediate compressor body 23.

The intermediate compressor body 23 sucks in the compressed gas compressed by each upstream-most compressor body 21 via the first connection line 30 connected to the outlet of each upstream-most compressor body 21 and further compresses the compressed gas. A second connection line 31 is connected to the outlet of the intermediate compressor body 23. The second connection line 31 is connected to the inlet of the downstream-most compressor body 24. The second connection line 31 is a pipe through which the compressed gas generated by the intermediate compressor body 23 is supplied to the downstream-most compressor body 24.

The downstream-most compressor body 24 sucks in the compressed gas compressed by the intermediate compressor body 23 via the second connection line 31 connected to the outlet of the intermediate compressor body 23 and further compresses the compressed gas.

A discharging line 29 is connected to the outlet of the downstream-most compressor body 24. The compressed gas compressed by the downstream-most compressor body 24 is supplied to a downstream process via the discharging line 29. The discharging line 29 is a pipe through which the compressed gas is supplied to the downstream process.

In the compressor system 1, as described above, a gas is supplied to each of the first upstream-most compressor body 21*a* and the second upstream-most compressor body 21*b* via the supply line 27. The gas is compressed by each of the first upstream-most compressor body 21*a* and the second upstream-most compressor body 21*b* and flows in the first connection line 30. The compressed gases are merged in the merging portion of the first connection line 30 and are then supplied to the intermediate compressor body 23. Likewise, the gas is further compressed by the intermediate compressor body 23 and is supplied to the downstream-most compressor body 24 via the second connection line 31. Likewise, the gas is further compressed by the downstream-most compressor body 24 and is discharged to the downstream process via the discharging line 29.

Inlet guide vanes (hereinafter referred to as IGVs) 32 (32*a* and 32*b*) controlling a flow rate of a gas supplied to the upstream-most compressor bodies 21 is provided in the supply line 27 in the vicinity of the inlet of each upstream-most compressor body 21. The first IGV 32*a* is provided in the first supply line 27*a* and the second IGV 32*b* is provided in the second supply line 27*b* to control the flow rates of the gases flowing in the corresponding upstream-most compressor bodies 21.

A blowoff valve 38 that can discharge the gas from the discharging line 29 is provided in the discharging line 29. The blowoff valve 38 discharges air into the atmosphere when the compressor is an air compressor of which the gas to be compressed is air. When the gas to be compressed by the compressor is nitrogen or the like, the blowoff valve can be used as a recycle valve. In this case, the gas can also be returned to the supply line 27 via a recycle line connected from the recycle valve to the supply line 27.

The opening degrees of the IGV 32 and the blowoff valve 38 are controlled to control the outlet pressure of the compressor, or to avoid surging.

Inlet flow rate detectors 33 (upstream-most flow rate detectors) that generate an inlet flow rate detection values by detecting inlet flow rates flowing in the upstream-most compressor bodies 21 are disposed in the supply line 27. A first inlet flow rate detector 33*a* is disposed in the first supply line 27*a* and a second inlet flow rate detector 33*b* is disposed in the second supply line 27*b*.

A post-merger pressure detector 34 that generates a post-merger pressure detection value by detecting a pressure after merging of the gases flowing out from the first upstream-most compressor body 21*a* and the second upstream-most compressor body 21*b* is disposed downstream from the merging portion in the first connection line 30.

An outlet pressure detector 35 that generates an outlet pressure detection value by detecting a pressure of the gas flowing out from the inlet of the downstream-most compressor body 24 is disposed in the discharging line 29.

An outlet flow rate detector 36 that generates an outlet flow rate detection value by detecting a flow rate of the gas flowing out from the outlet of the downstream-most compressor body 24 is disposed in the discharging line 29.

A cooler 39 that cools the gas flowing inside is disposed in each of the first connection line 30 and the second connection line 31.

Next, the configuration of the compressor control device 201 will be described.

Figure 2:
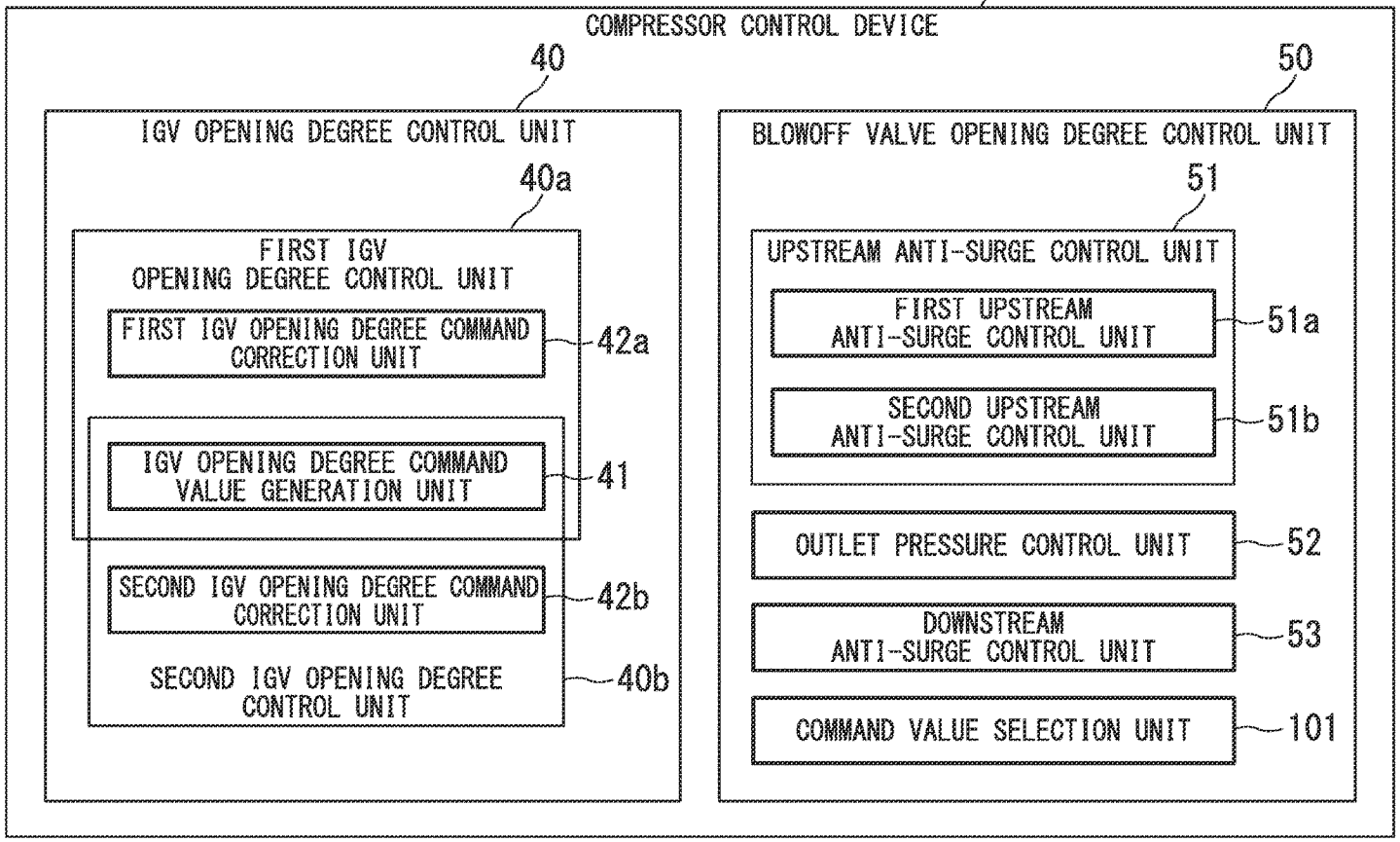
FIG. 2 is a diagram showing the configuration of a compressor control device according to the first embodiment of the present invention.

As shown in FIG. 2, the compressor control device 201 includes an IGV opening degree control unit 40 and a blowoff valve opening degree control unit 50. The IGV opening degree control unit 40 controls an opening degree of the IGV 32. The IGV opening degree control unit 40 is configured to include a first IGV opening degree control unit 40*a* and a second IGV opening degree control unit 40*b*. The first IGV opening degree control unit 40*a* controls an opening degree of the first IGV 32*a* and the second IGV opening degree control unit 40*b* controls an opening degree of the second IGV 32*b*. Since the configuration of the first IGV opening degree control unit 40*a* is the same as that of the second IGV opening degree control unit 40*b*, the suffixes a and b will be omitted from the reference numerals and a joint description thereof will be provided. When the IGV opening degree control units are described individually, the IGV opening degree control units are distinguished by indicating the suffixes a and b on the reference numerals.

The IGV opening degree control unit 40 (40*a* or 40*b*) includes an IGV opening degree command value generation unit 41 and an IGV opening degree command value correction unit 42 (42*a* or 42*b*). The IGV opening degree command value generation unit 41 is usable by both the first IGV opening degree control unit 40*a* and the second IGV opening degree control unit 40*b*. The IGV opening degree command value correction unit 42 is configured to include a first IGV opening degree command value correction unit 42*a* and a second IGV opening degree command value correction unit 42*b*.

The IGV opening degree command value generation unit 41 generates an IGV opening degree command value indicating an opening degree of the IGV 32 and outputs the IGV opening degree command value. The IGV opening degree command value generation unit 41 includes a pressure controller 91 and a function generator 61.

Each IGV opening degree command value correction unit 42 corrects the IGV opening degree command value output by the IGV opening degree command value generation unit 41.

Each IGV opening degree command value correction unit 42 includes a flow rate indicator 81 (81*a* or 81*b*) that outputs the input inlet flow rate detection value without change, a pressure indicator 82 that outputs the input post-merger pressure detection value without change, a divider 71 (71*a* or 71*b*) that divides the inlet flow rate detection value by the post-merger pressure detection value and outputs the divided result, and a function generator 62 (62*a* or 62*b*) that outputs an IGV opening degree correction value. The flow rate indicators 81 include a first flow rate indicator 81*a* corresponding to the first IGV opening degree command value correction unit 42*a* and a second flow rate indicator 81*b* corresponding to the second IGV opening degree command value correction unit 42*b*. The dividers 71 include a first divider 71*a* corresponding to the first IGV opening degree command value correction unit 42*a* and a second divider 71*b* corresponding to the second IGV opening degree command value correction unit 42*b*. The function generators 62 include a first function generator 62*a* corresponding to the first IGV opening degree command value correction unit 42*a* and a second function generator 62*b* corresponding to the second IGV opening degree command value correction unit 42*b*. The pressure indicator 82 is configured to be usable by both the first IGV opening degree command value correction unit 42*a* and the second IGV opening degree command value correction unit 42*b*, but the present invention is not limited thereto.

The blowoff valve opening degree control unit 50 controls an opening degree of the blowoff valve 38. As shown in FIG. 2, the blowoff valve opening degree control unit 50 includes an upstream anti-surge control unit 51, an outlet pressure control unit 52, a downstream anti-surge control unit 53, and a command value selection unit 101. Here, anti-surge control refers to a control process performed such that a flow rate is maintained to be equal to or greater than a certain value in order to prevent damage to the compressor due to so-called surging occurring when the flow rate is decreased in the compressor.

The upstream anti-surge control unit 51 controls an opening degree of the blowoff valve 38 in order to prevent surging from occurring in the upstream-most compressor bodies 21. The upstream anti-surge control unit 51 includes a first upstream anti-surge control unit 51*a* and a second upstream anti-surge control unit 51*b*. The first upstream anti-surge control unit 51*a* controls an opening degree of the blowoff valve 38 in order to prevent surging from occurring in the first upstream-most compressor body 21*a*. The second upstream anti-surge control unit 51*b* controls an opening degree of the blowoff valve 38 in order to prevent surging from occurring in the second upstream-most compressor body 21*b*. Here, since the configuration of the first upstream anti-surge control unit 51*a* is the same as that of the second upstream anti-surge control unit 51*b*, the suffixes a and b will be omitted from the reference numerals and a joint description thereof will be provided. When the upstream anti-surge control units are described individually, the upstream anti-surge control units are distinguished by indicating the suffixes a and b on the reference numerals.

The upstream anti-surge control unit 51 (51*a* or 51*b*) includes a pressure indicator 82 that outputs an input post-merger outlet pressure detection value without change, a function generator 63 (63*a* or 63*b*) that outputs an inlet flow rate target value, a flow rate indicator 81 (81*a* or 81*b*) that outputs an input inlet flow rate detection value without change, and a flow rate controller 92 (92*a* or 92*b*) that outputs a first blowoff opening degree command value based on the inlet flow rate target value. The function generators 63 include a first function generator 63*a* corresponding to the first upstream anti-surge control unit 51*a* and a second function generator 63*b* corresponding to the second upstream anti-surge control unit 51*b*. The flow rate indicators 81 include a first flow rate indicator 81*a* corresponding to the first upstream anti-surge control unit 51*a* and a second flow rate indicator 81*b* corresponding to the second upstream anti-surge control unit 51*b*. The flow rate controllers 92 include a first flow rate controller 92*a* corresponding to the first upstream anti-surge control unit 51*a* and a second flow rate controller 92*b* corresponding to the second upstream anti-surge control unit 51*b*. The pressure indicator 82 is configured to be commonly used by both the first upstream anti-surge control unit 51*a* and the second upstream anti-surge control unit 51*b*, but the present invention is not limited thereto.

The outlet pressure control unit 52 includes a pressure controller 91 that outputs a manipulation value so that an input outlet pressure detection value is a set value and a function generator 64 that outputs a second blowoff valve opening degree command value.

The downstream anti-surge control unit 53 includes a function generator 65 that outputs an outlet flow rate target value and a flow rate controller 93 that outputs a third blowoff opening degree command value based on the outlet flow rate target value.

Next, a control process by the compressor control device 201 will be described. First, a control process of the IGV opening degree control unit 40 (40*a* or 40*b*) will be described.

A control process of the IGV opening degree command value generation unit 41 in the IGV opening degree control unit 40 will be described.

As shown in FIG. 1, an outlet pressure detection value generated by the outlet pressure detector 35 is input to the pressure controller 91. The pressure controller 91 generates and outputs a manipulation value so that the input outlet pressure detection value becomes a set value.

The manipulation value generated and output from the pressure controller 91 is input to the function generator 61. The function generator 61 generates an IGV opening degree command value using the input manipulation value by a predetermined function FX61 set in advance and outputs the IGV opening degree command value.

Figure 3:
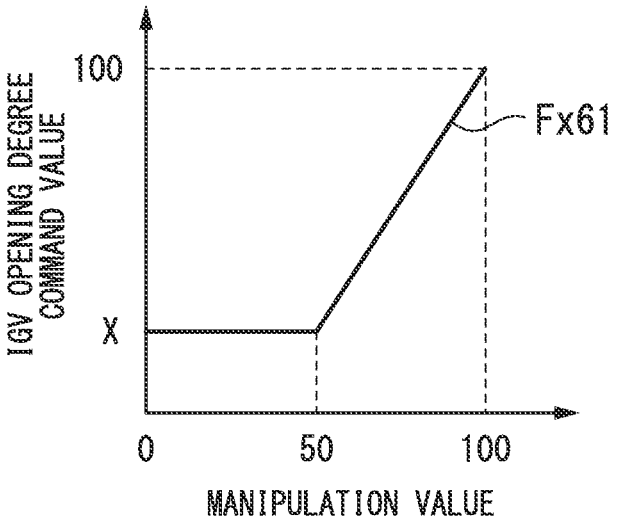
FIG. 3 is a diagram showing a function FX61.

In the embodiment, as shown in FIG. 3, the function FX61 is function in which the IGV opening degree command value is a fixed value of X % when the manipulation value is in the range of 0% to 50%, the magnitude of the IGV opening degree command value monotonically increases in proportion to the magnitude of the manipulation value when the magnitude of the manipulation value exceeds 50%, and the IGV opening degree command value becomes 100% when the manipulation amount is 100%.

In general, the IGV is a throttle type control valve and control precision is lowered due to the structure of the IGV when an opening degree of the IGV is equal to or less than a given opening degree. Therefore, the opening degree is set to a minimum opening degree θ. The IGV is used by controlling the opening degree in a range from the minimum opening degree θ to the fully open opening degree without fully closing. Accordingly, when the opening degree is controlled, a manipulation amount corresponding to the minimum opening degree θ is set to X % and a manipulation amount corresponding to a fully open state is set to 100%.

A control process of each IGV opening degree command value correction unit 42 (42*a* or 42*b*) in each IGV opening degree control unit 40 will be described.

The inlet flow rate detection value generated in the corresponding inlet flow rate detector 33 (33*a* or 33*b*) is input to each flow rate indicator 81 (81*a* or 81*b*) and the inlet flow rate detection value is output without change.

The post-merger pressure detection value generated in the post-merger pressure detector 34 is input to the pressure indicator 82 and the post-merger pressure detection value is output without change.

The inlet flow rate detection value output from the corresponding flow rate indicator 81 and the post-merger pressure detection value output from the pressure indicator 82 are input to each divider 71 (71*a* or 71*b*). Each divider 71 generates and outputs an IGV opening degree command correction value by dividing the inlet flow rate detection value by the post-merger pressure detection value. The IGV opening degree command correction value is a value used to correct the IGV opening degree command value. The output IGV opening degree command correction value is input to the corresponding function generator 62 (62*a* or 62*b*).

Here, instead of each inlet flow rate detector 33, a flow rate detector may be provided in the vicinity of the outlet of each upstream-most compressor body 21 and an upstream-most pressure outlet flow rate detection value detected by the flow rate detector (upstream-most flow rate detector) may be input to the divider.

The IGV opening degree command correction value output from the corresponding divider 71 and the IGV opening degree command value output from the function generator 61 in the IGV opening degree command value generation unit 41 are input to each function generator 62. Each function generator 62 corrects the IGV opening degree command value based on the IGV opening degree command correction value to generate and output the IGV opening degree correction value. The output IGV opening degree correction value is input to the corresponding IGV 32 (32*a* or 32*b*). The opening degree of the IGV 32 is controlled based on the input IGV opening degree correction value.

In each function generator 62, a function is set in advance so that the IGV opening degree command value is further corrected as the IGV opening degree command correction value is a larger value. This ensures as large a margin as possible from a surge line. Here, in each function generator 62, a function incorporating a pre-known individual difference between the first upstream-most compressor body 21*a* and the second upstream-most compressor body 21*b* is set. Further, in each function generator 62, a function incorporating aging degradation may be set.

Figure 5:
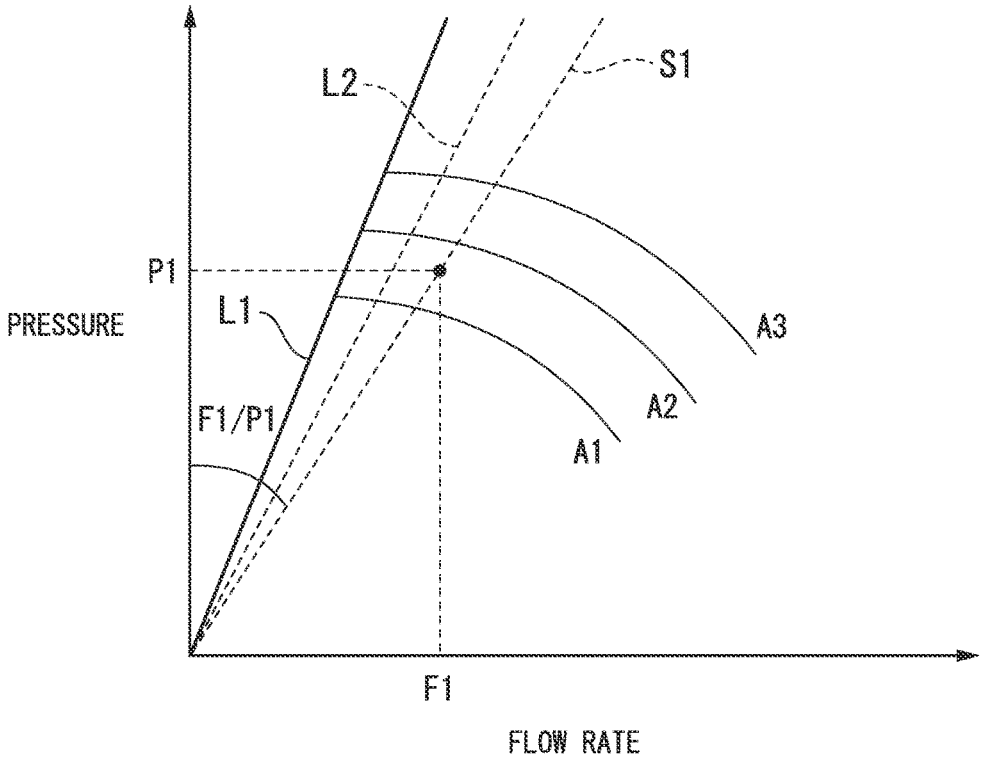
FIG. 5 is a diagram showing a performance curve of a compressor to describe an idea of correction of an IGV opening degree command value correction unit according to the first embodiment.

In each function generator 62, the IGV opening degree command value is corrected based on the following way of thinking. In FIG. 5, lines A1, A2, and A3 are curves of a pressure P and a flow rate F at each opening degree of the IGV. In particular, the line A3 is a curve of the pressure P and the flow rate F when the opening degree of the IGV is the maximum (fully open). The line L1 is a surge line and a region on the left side of the line L1 is a region in which surging occurs. Therefore, normally, the pressure and the flow rate of the compressor are controlled in a region on the right side of a surge control line L2 with a margin of about 10% from the surge line L1.

When F1 is assumed to be an inlet flow rate detection value and P1 is assumed to be a post-merger pressure detection value, a value obtained by dividing the inlet flow rate detection value F1 by the post-merger pressure detection value P1, i.e., the IGV opening degree command correction value, corresponds to a reciprocal of the slope of a straight line S1. As this value is smaller, the value approximates the surge line L1 and surge is considered to occur more easily.

Therefore, a function FX62 is set in each function generator 62 so that the IGV opening degree command value is corrected in a direction away from the surge line as the IGV opening degree command correction value is smaller. The IGV opening degree command value is corrected based on the function FX62 and the IGV opening degree correction values is generated and output. In this case, the function generator 62 may perform the correction based on a difference between a predetermined value derived from the IGV opening degree command correction value and the IGV opening degree command value, or may set a predetermined value expressed in a ratio and perform the correction by multiplying the IGV opening degree command value by the predetermined value.

The foregoing process is performed by each of the first IGV opening degree control unit 40*a* and the second IGV opening degree control unit 40*b*, so that the opening degree of each of the first IGV 32*a* and the second IGV 32*b* is controlled.

Next, a control process in the blowoff valve opening degree control unit 50 will be described. First, a control process of the upstream anti-surge control unit 51 (51*a* or 51*b*) will be described.

As shown in FIG. 1, the post-merger pressure detection value generated by the post-merger pressure detector 34 is input to the pressure indicator 82. The pressure indicator 82 outputs the input post-merger pressure detection value without change.

The post-merger pressure detection value output from the pressure indicator 82 is input to each function generator 63 (63*a* or 63*b*). Each function generator 63 calculates an inlet flow rate target value by a preset function from the input post-merger pressure detection value and outputs the inlet flow rate target value. The inlet flow rate target value is a predetermined flow rate necessary to prevent surging from occurring in the corresponding upstream-most compressor body 21 (21*a* or 21*b*).

The inlet flow rate detection value generated by the corresponding inlet flow rate detector 33 (33*a* or 33*b*) is input to each flow rate indicator 81 (81*a* or 81*b*). Each flow rate indicator 81 outputs the inlet flow rate detection value without change. The flow rate indicator 81 is same as that used by the IGV opening degree command value correction unit 42 of the IGV opening degree control unit 40, but the present invention is not limited thereto.

The inlet flow rate target value output from the corresponding function generator 63 and the inlet flow rate detection value output from the corresponding flow rate indicator 81 are input to each flow rate controller 92 (92*a* or 92*b*). Each flow rate controller 92 outputs a first blowoff valve opening degree command value so that the inlet flow rate detection value is the inlet flow rate target value. The first blowoff valve opening degree is output from each of the first upstream anti-surge control unit 51*a* and the second upstream anti-surge control unit 51*b*.

Next, a control process in the outlet pressure control unit 52 will be described.

The outlet pressure detection value generated by the outlet pressure detector 35 is input to the pressure controller 91. The pressure controller 91 generates a manipulation value so that the input outlet pressure detection value is a set value and outputs the manipulation value. The pressure controller 91 is same as that used by the IGV opening degree command value generation unit 41 of the IGV opening degree control unit 40, but the present invention is not limited thereto. That is, the manipulation value is input to the function generators 61 and 64. Further, the present invention is not limited thereto. The configuration in which the manipulation value is input to the function generator 61 may be different from the configuration in which the manipulation value is input to the function generator 64.

Figure 4:
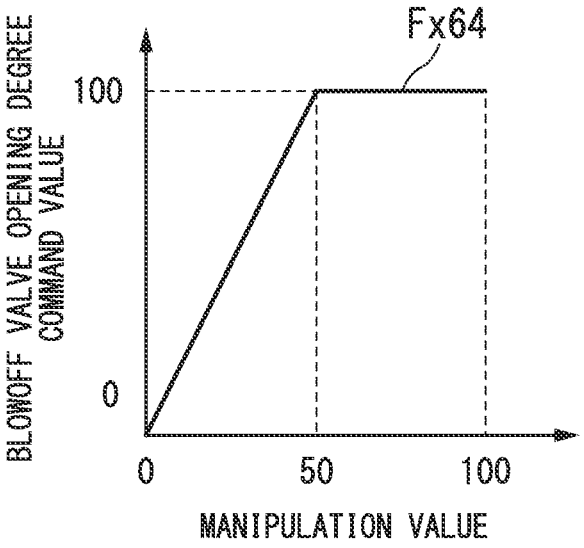
FIG. 4 is a diagram showing a function FX64.

The manipulation value generated by the pressure controller 91 is input to the function generator 64. The function generator 64 generates a second blowoff valve opening degree command value using the input blowoff valve opening degree command value by the preset function FX64 and outputs the second blowoff valve opening degree command value. In the embodiment, as shown in FIG. 4, the function FX64 is a function in which the blowoff valve opening degree command value monotonically increases in proportion to the magnitude of the manipulation value when the manipulation value is in the range of 0% to 50% and the second blowoff valve opening degree command value is a constant value of 100% when the magnitude of the manipulation value exceeds 50%. This is because the amount of gas blown off from the compressor can be minimized by performing control by the blowoff valve opening degree at a given manipulation value at the minimum IGV opening degree such that the IGV opening degree is controlled when the blowoff valve is in a fully closed state (in which the opening degree command value is 100%), thereby improving working efficiency.

Next, a control process in the downstream anti-surge control unit 53 will be described. The outlet pressure detection value generated by the outlet pressure detector 35 is input to the function generator 65. The function generator 65 generates an outlet flow rate target value based on the input outlet pressure detection value by a preset function and outputs the outlet flow rate target value. A function FX65 is a function indicating a relation between the outlet pressure detection value and the outlet flow rate target value. The outlet flow rate target value is a predetermined flow rate necessary to prevent surging from occurring in the outlet of the compressor.

The outlet flow rate target value output from the function generator 65 and the outlet flow rate detection value generated by the outlet flow rate detector 36 are input to the flow rate controller 93. The flow rate controller 93 outputs a third blowoff valve opening degree command value so that the outlet flow rate detection value is the outlet flow rate target value output from the function generator 65.

Each blowoff valve opening degree command value is input to the command value selection unit 101. The command value selection unit 101 selects a command value by which the blowoff valve opening degree is the largest and outputs the command value to the blowoff valve 38. This is because the control can be performed more safely against the surging by performing the control such that the opening degree of the blowoff valve 38 is large. The blowoff valve opening degree command value output from the command value selection unit 101 is input to the blowoff valve 38, so that the opening degree thereof is controlled.

Next, operations of the first embodiment will be described.

In each IGV opening degree control unit 40, the IGV opening degree command value calculated by the pressure controller 91 and the function generator 61 is corrected based on the IGV opening degree command correction value generated by dividing the inlet flow rate detection value in each of the plurality of upstream-most compressor bodies by the post-merger pressure detection value based on the outlet pressure detection value, and the corrected value can be input to the corresponding IGV 32. Thus, the inlet flow rate detection value in each of the plurality of upstream-most compressor bodies 21 is considered in the control of the opening degree of the IGV 32. Accordingly, the IGV opening degree correction value can be output to the corresponding IGV 32 in consideration of a difference in the performance between the plurality of upstream-most compressor bodies 21. In this way, it is possible to properly control the opening degree of each of the first IGV 32*a* and the second IGV 32*b*.

In the related art, anti-surge control has been performed using an outlet flow rate detection value, i.e., the entire flow rate of a compressor. Therefore, when a difference in performance occurs due to an individual difference or aging degradation between the plurality of upstream-most compressor bodies 21 or a process failure occurs in the IGV 32, there is a probability of anti-surge control not being properly performed. In the blowoff valve opening degree control unit 50 according to the embodiment; however, the anti-surge control is performed using the inlet flow rate detection value in each of the upstream-most compressor bodies 21 in addition to the anti-surge control using the outlet flow rate detection value. Thus, even when a difference in performance occurs due to an individual difference or aging degradation between the plurality of upstream-most compressor bodies 21 or a process failure occurs in the IGV 32, it is possible to reliably prevent surging from occurring. Therefore, it is possible to prevent the compressor from being damaged due to the surging.

Each blowoff valve opening degree command value may be configured to have a smaller value as the opening degree of the blowoff valve to be commanded is larger. The command value selection unit 101 may be a low selector that selects the smallest value among the input values and outputs the smallest value. Thus, when an input signal is lost, the opening degree of the blowoff valve 38 is controlled such that the blowoff valve 38 is fully opened. Therefore, it is possible to perform the control on safely against the surging.

Next, a compressor control device 202 according to a second embodiment will be described. In the second embodiment, the same reference numerals are given to the same constituent elements as those of the first embodiment and a detailed description thereof will be omitted here. The same also applies to the following embodiments.

Figure 6:
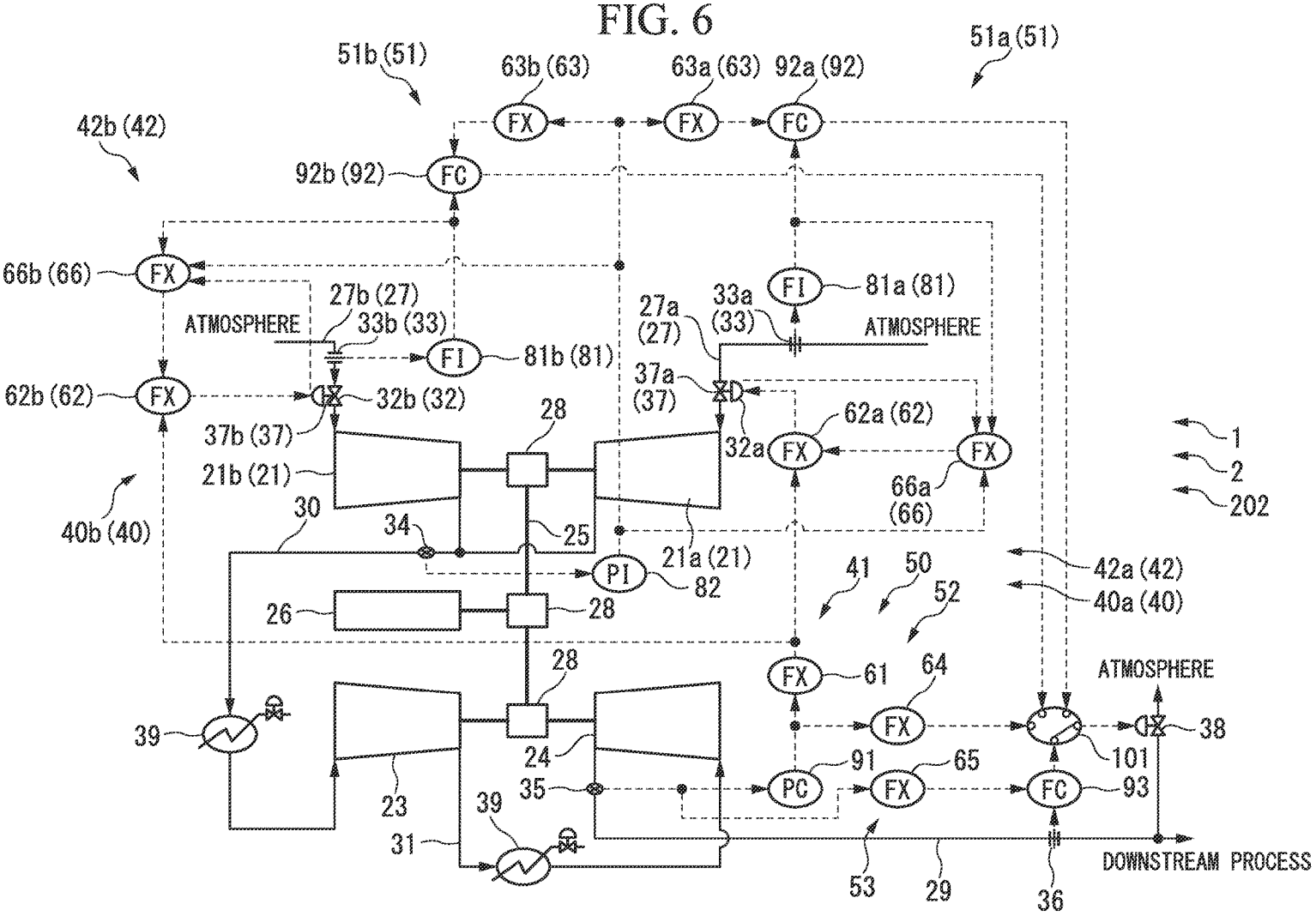
FIG. 6 is a diagram showing the configuration of a compressor system according to a second embodiment of the present invention.

As shown in FIG. 6, in an IGV opening degree control unit 40 (40*a* or 40*b*) of the compressor control device 202 according to the embodiment, each IGV opening degree command value correction unit 42 (42*a* or 42*b*) includes a function generator 66 (66*a* or 66*b*). The function generators 66 include a first function generator 66*a* corresponding to the first IGV opening degree command value correction unit 42*a* and a second function generator 66*b* corresponding to the second IGV opening degree command value correction unit 42*b*. A post-merger input detection value generated by a post-merger pressure detector 34 and output via a pressure indicator 82, an IGV opening degree detection value generated by an IGV opening degree detector 37 (37*a* or 37*b*) provided in a corresponding IGV 32 (32*a* or 32*b*), and an inlet flow rate detection value generated by an inlet flow rate detector 33 and output via a flow rate indicator 81 are input to each function generator 66. Each function generator 66 calculates an inlet flow rate estimation value based on the post-merger pressure detection value and the IGV opening degree detection value by a preset function FX66, calculates an IGV opening degree correction command value based on a difference between the inlet flow rate estimation value and the inlet flow rate detection value, and outputs the IGV opening degree correction command value to a corresponding function generator 62 (62*a* or 62*b*). Each function generator 62 performs the same process as that of the first embodiment.

A control process of a compressor control device 202 according to the second embodiment will be described.

Figure 7:
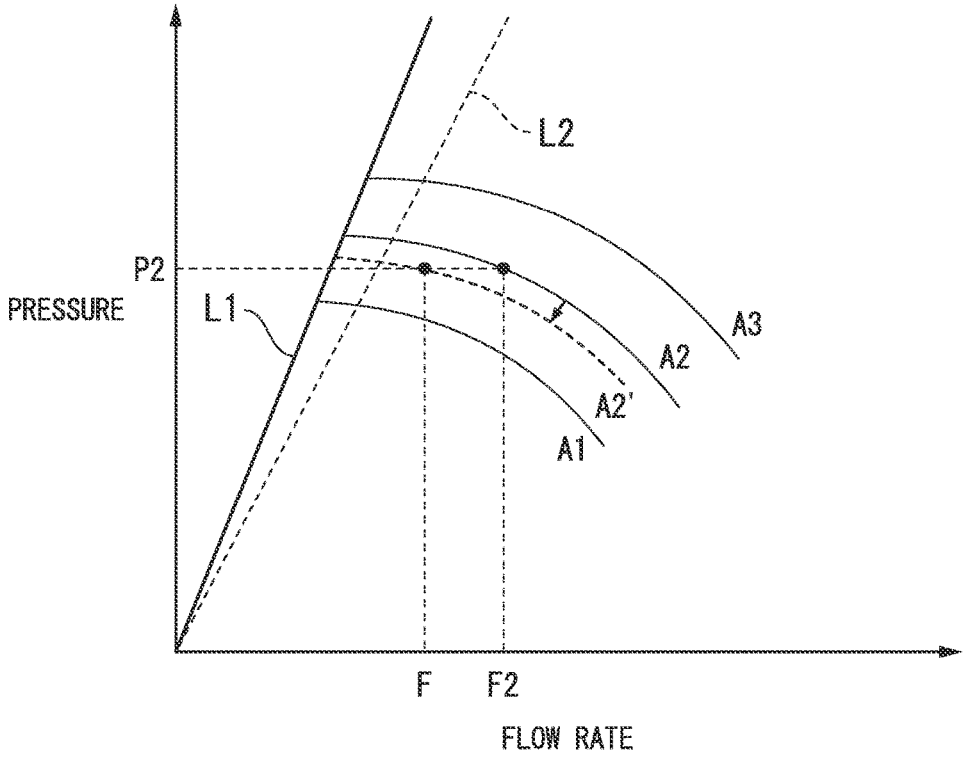
FIG. 7 is a diagram showing a performance curve of a compressor to show an idea of correction of an IGV opening degree command value correction unit according to the second embodiment.

FIG. 7 is a graph showing a performance curve of the corresponding upstream-most compressor body 21 set in each function generator 66. The signs in the graph are the same as those of FIG. 5. F2 is assumed to be the flow rate estimation value calculated based on an IGV opening degree detection value A2 and a post-merger pressure detection value P2. Here, when the inlet flow rate detection value is F, a performance curve of the upstream-most compressor body 21 is considered to be changed from A2 to A2'. Therefore, the control is performed such that the opening degree of the corresponding IGV 32 increases so that the inlet flow rate detection value becomes the inlet flow rate estimation value.

Operations of the second embodiment will be described. In the embodiment, the opening degree of the IGV 32 is controlled such that the inlet flow rate detection value becomes the inlet flow rate estimation value estimated from the actual opening degree of the corresponding IGV 32. Therefore, even when the performance of each upstream-most compressor body is changed from the initial performance, it is possible to properly prevent the surging from occurring and thus it is possible to prevent the performance of the entire compressor from being degraded.

Next, a compressor control device 203 according to a third embodiment will be described.

Figure 8:
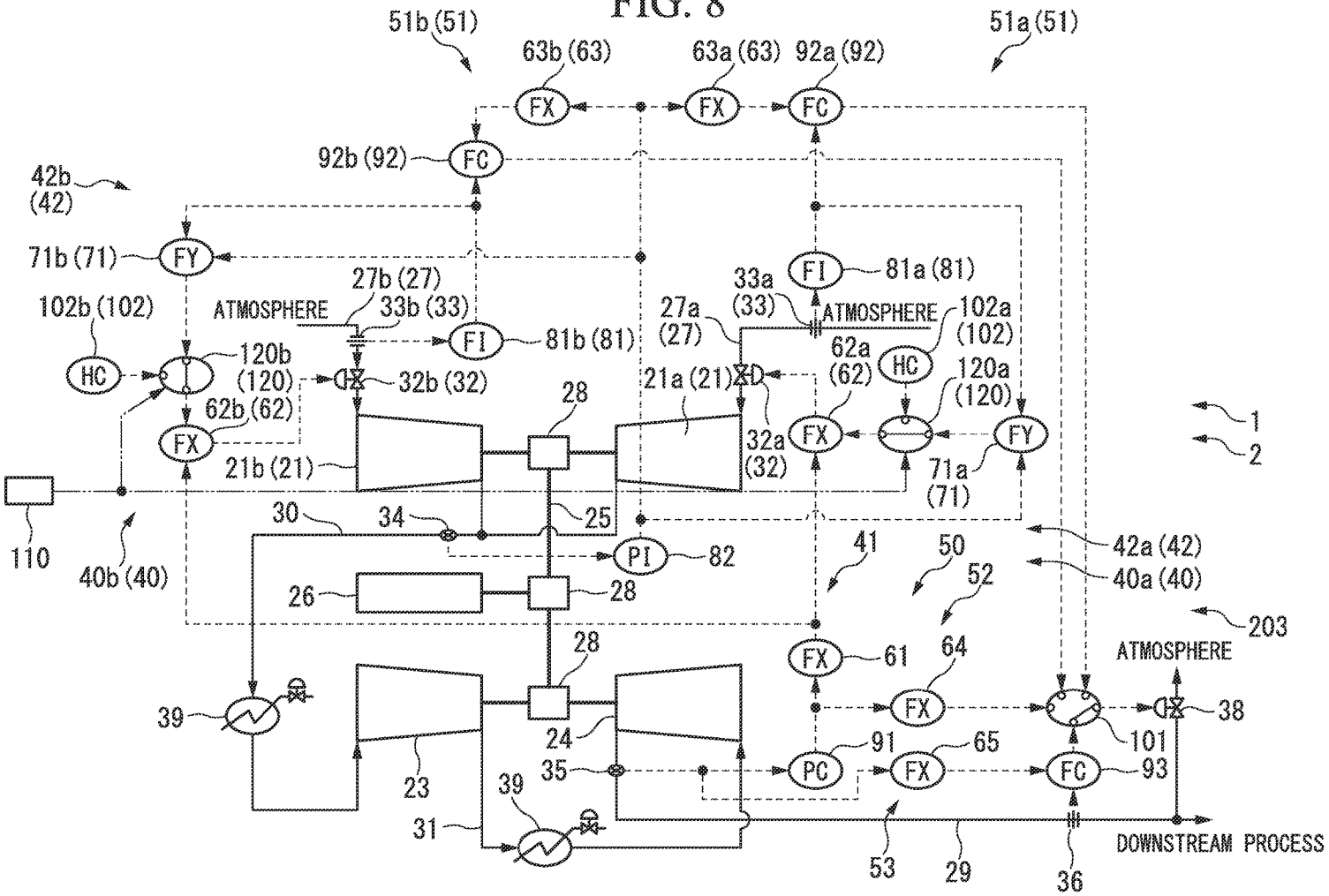
FIG. 8 is a diagram showing the configuration of a compressor system according to a third embodiment of the present invention.

In FIG. 8, an IGV opening degree command value correction unit 42 (42*a* or 42*b*) in an IGV opening degree control unit 40 (40*a* or 40*b*) includes a correction cancellation signal generation unit 102 (102*a* or 102*b*) and a command value selection unit 120 (120*a* or 120*b*). The correction cancellation signal generation units 102 include a first correction cancellation signal generation unit 102*a* corresponding to the first IGV opening degree command value correction unit 42*a* and a second correction cancellation signal generation unit 102*b* corresponding to the second IGV opening degree command value correction unit 42*b*. The command value selection units 120 include a command value selection unit 120*a* corresponding to the first IGV opening degree command value correction unit 42*a* and a second command value selection unit 120*b* corresponding to the second IGV opening degree command value correction unit 42*b*. Each correction cancellation signal generation unit 102 generates and outputs a correction cancellation signal. Each output correction cancellation signal is input to the corresponding command value selection unit 120. The corresponding correction cancellation signal and the IGV opening degree command correction value are input to each command value selection unit 120. Here, the correction cancellation signal refers to a signal cancelling the IGV opening degree command correction value input to the corresponding command value selection unit 120. Specifically, when the IGV opening degree command correction value is a value having a feature of correcting the IGV opening degree command value by the difference, a non-correction signal is a signal in which a value is set to 0. Further, when the IGV opening degree command correction value is a value expressed in a ratio and having a feature of correcting the IGV opening degree command value, the non-correction signal is a signal in which the value is set to 1.

The compressor according to the embodiment further includes an alarm 110. The alarm 110 is provided in a device such as a flow rate detector, a pressure detector, or an actuator.

A control process of the compressor control device 203 according to the third embodiment will be described.

When an abnormality such as breakdown of the actuator occurs and the alarm 110 detects the abnormality, the alarm 110 outputs an alarm signal to each command value selection unit 120. When the alarm signal is input, each command value selection unit 120 selects the correction cancellation signal. When the alarm signal is not input, each command value selection unit 120 selects the IGV opening degree command correction value and outputs the IGV opening degree command correction value to the corresponding function generator 62.

Each function generator 62 performs the same process as that of the first embodiment.

Operations of the third embodiment will be described. When an abnormality of an actuator, a flowmeter, or a manometer or a degradation abnormality occurs, it is not necessary to correct a difference in performance of each upstream-most compressor body 21 in some cases. In such cases, the alarm signal can be input to each command value selection unit 120 and each command value selection unit 120 can select a corresponding correction cancellation signal. Thus, since whether or not the correction is performed can be switched, it is possible to prevent unnecessary correction from being performed.

Next, a compressor control device 204 according to a fourth embodiment will be described.

Figure 9:
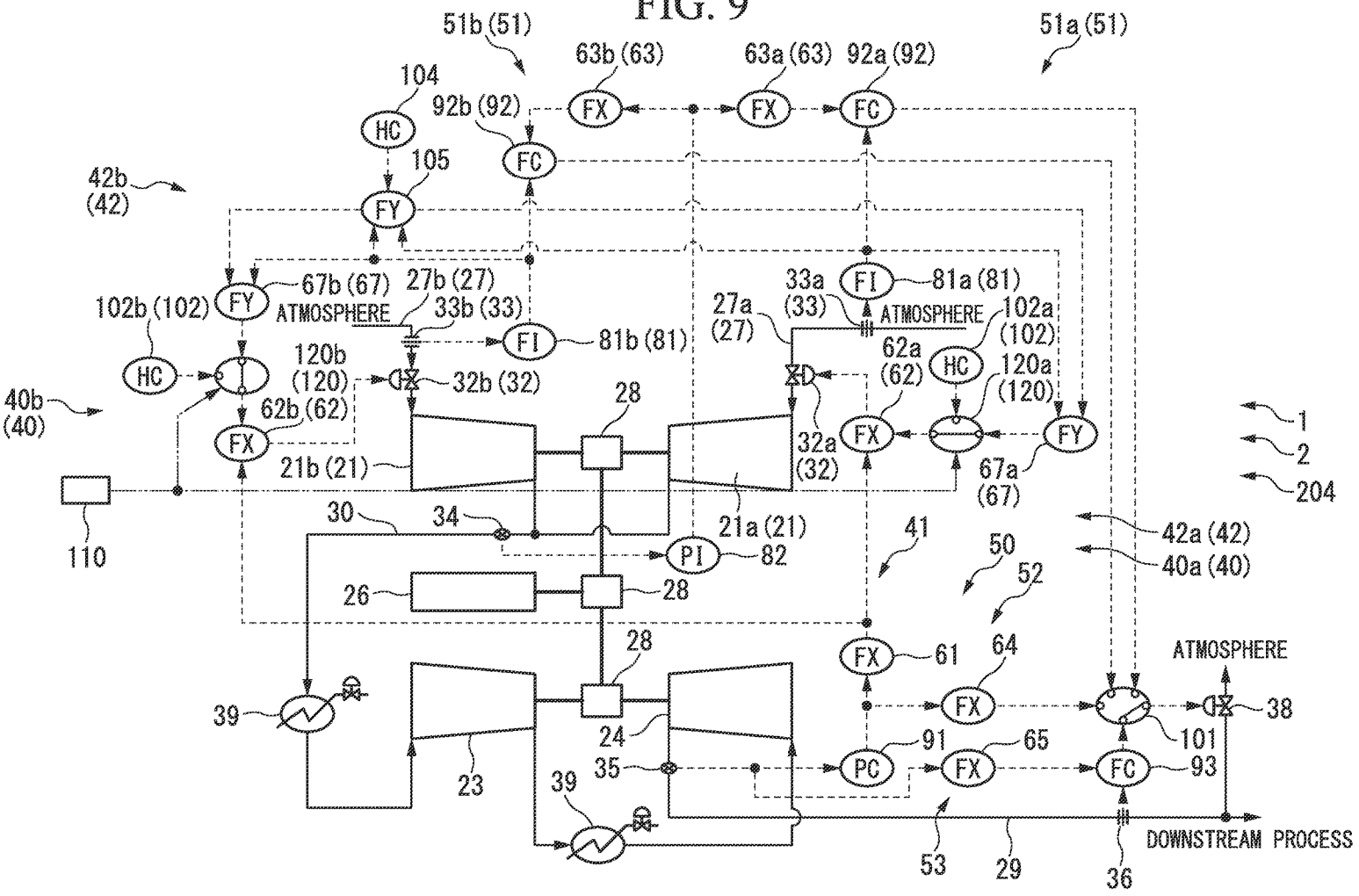
FIG. 9 is a diagram showing the configuration of a compressor system according to a fourth embodiment of the present invention.

In FIG. 9, an IGV opening degree command value correction unit 42 (42*a* or 42*b*) in an IGV opening degree control unit 40 (40*a* or 40*b*) includes a performance difference correction coefficient generation unit 104, an inlet flow rate target value generation unit 105, and a function generator 67 (67*a* or 67*b*). The function generators 67 include a function generator 67*a* corresponding to the first IGV opening degree command value correction unit 42*a* and a function generator 67*b* corresponding to the second IGV opening degree command value correction unit 42*b*. The performance difference correction coefficient generation unit 104 and the inlet flow rate target value generation unit 105 are usable by both the first IGV opening degree command value correction unit 42*a* and the second IGV opening degree command value correction unit 42*b*. The performance difference correction coefficient generation unit 104 generates and outputs a performance difference correction coefficient indicating a difference in performance between the plurality of upstream-most compressor bodies 21. The performance difference correction coefficient and the inlet flow rate detection value of each of the plurality of corresponding upstream-most compressor bodies 21 are input to the inlet flow rate target value generation unit 105, so that an inlet flow rate target value is generated in each of the plurality of upstream-most compressor bodies 21. The inlet flow rate target value is input to the corresponding function generator 67. Each function generator 67 is provided to correspond to one of the command value selection units 120.

The inlet flow rate target value and the inlet flow rate detection value output from the corresponding flow rate indicator 81 (81*a* or 81*b*) are input to each function generator 67. Each function generator 67 generates and outputs an IGV opening degree command correction value proportional to a difference between the inlet flow rate target value and the flow rate detection value. Here, each function generator 67 may generate and output an IGV opening degree command correction value in consideration of integration of the differences between the inlet flow rate target values and the inlet flow rate detection values.

A control process of the compressor control device 204 according to the fourth embodiment will be described.

Figure 10:
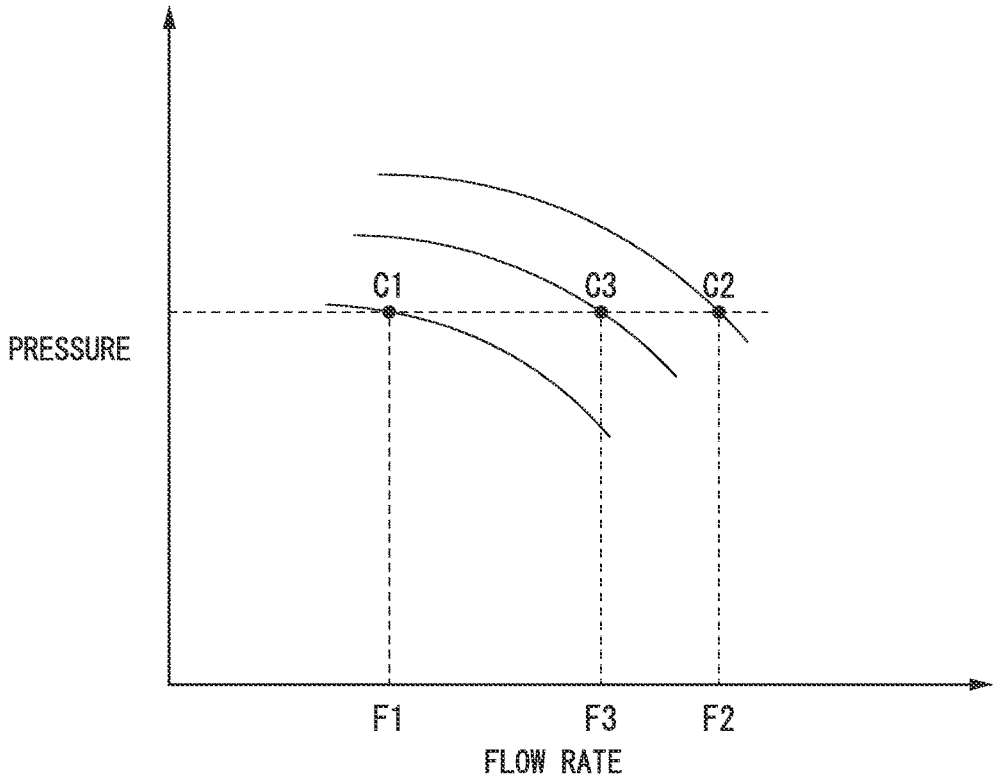
FIG. 10 is a diagram showing a performance curve of a compressor to show an idea of correction of an IGV opening degree command value correction unit according to the fourth embodiment.

In FIG. 10, C1 is a plot indicating the performance of the first upstream-most compressor body 21.

C2 is a plot indicating the performance of the second upstream-most compressor body 21. The inlet flow rate target value generation unit 105 calculates an inlet flow rate target value F3 by Math 1 based on the inlet flow rate detection value in each of the first upstream-most compressor body 21 and the second upstream-most compressor body 21 and a performance difference correction coefficient α generated by the performance difference correction coefficient generation unit 104. F3 indicates a flow rate indicated by the plot of C3 in FIG. 10. Accordingly, when an intermediate value of F1 and F2 is desired to be set as a flow rate target value, a is generated as 0.5. Further, a may be generated through manual input or may be generated automatically.

$$F3=F1\times\alpha+F2\times(1-\alpha) \quad \text{[Math 1]}$$

Operations of the fourth embodiment will be described.

The performance difference correction coefficient generation unit 104 can adjust and generate a correction coefficient indicating the difference in performance between the plurality of upstream-most compressor bodies 21, and thus the opening degree of the IGV 32 provided in each of the plurality of upstream-most compressor bodies 21 can be controlled based on the correction coefficient. Thus, the correction amount by the difference in the performance between the upstream-most compressor bodies 21 can be adjusted according to a situation. For example, when working is desired to be performed in a region further away from surging, the working can be realized by generating a smaller α.

The embodiments of the present invention have been described in detail above with reference to the drawings, but specific configurations are not limited to the embodiments and design modifications or the like can also be made within the scope of the present invention without departing from the gist of the present invention.

For example, in each embodiment described above, the inlet flow rate detector 33 is disposed in each of the upstream-most compressor bodies 21 (21*a* and 21*b*) to detect the inlet flow rate and generate the inlet flow rate detection value. In each embodiment, the IGV opening degree command value calculation unit obtains the IGV opening degree correction value based on the generated inlet flow rate detection value. However, instead of the inlet flow rate detector 33, an outlet flow rate detector (upstream-most flow rate detector) detecting an outlet flow rate and generating an outlet flow rate detection value may be provided in each of the upstream-most compressor bodies 21 and may obtain an IGV opening degree correction value based on the outlet flow rate detection value instead of the inlet flow rate detection value. Likewise, in each embodiment, the upstream anti-surge control unit outputs the first blowoff valve opening degree command value so that the inlet flow rate becomes the inlet flow rate target value based on the generated inlet flow rate detection value. However, instead of the inlet flow rate detector 33, an outlet flow rate detector (upstream-most flow rate detector) detecting an outlet flow rate and generating an outlet flow rate detection value may be provided in each of the upstream-most compressor bodies 21, may estimate an inlet flow rate from the outlet flow rate detection value instead of the inlet flow rate detection value, and may output the first blowoff valve opening degree command value so that the inlet flow rate becomes the inlet flow rate target value. That is, in each embodiment, the inlet flow rate or the outlet flow rate may be detected as an upstream-most flow rate flowing through each upstream-most compressor body, an upstream-most flow rate detection value (an inlet flow rate detection value or an outlet flow rate detection value) may be generated, an IGV opening degree correction value may be obtained based on the upstream-most flow rate detection value, and the first blowoff valve opening degree command value may be output.

The compressor control device and the control method therefor, and the compressor system described above can be applied to a compressor control device and a control method therefor, and a compressor system in which a plurality of compressor bodies are provided. The compressor control device and the control method therefor, and the compressor system described above are suitable for a compressor control device and a control method therefor, and a compressor system capable of optimally working by properly controlling opening degrees of inlet guide vanes particularly even when a difference in performance occurs between a plurality of compressor bodies.

REFERENCE SIGNS LIST

1 Compressor system
2 Compressor
21 Upstream-most compressor body
22 Downstream compressor body
32 Inlet guide vane (IGV)
33 Inlet flow rate detector
34 Post-merger pressure detector
35 Outlet pressure detector
36 Outlet flow rate detector
37 Inlet guide vane opening degree detector
38 Blowoff valve
40 Inlet guide vane opening degree control unit
41 Inlet guide vane opening degree command value generation unit
42 Inlet guide vane opening degree command value correction unit
50 Blowoff valve opening degree control unit
51 Upstream anti-surge control unit
52 Outlet pressure control unit
53 Downstream anti-surge control unit
101, 120 Command value selection unit
102 Correction cancellation signal generation unit
104 Performance difference correction coefficient generation unit
105 Inlet flow rate target generation unit
110 Alarm
201, 202, 203, 204 Compressor control device

The invention claimed is:

1. A compressor control device controlling a compressor, the compressor comprising:

a plurality of upstream-most compressor bodies disposed furthest upstream;

at least one stage of downstream compressor bodies which is disposed downstream from the plurality of upstream-most compressor bodies and in which a gas merged after outflow of gases from the plurality of upstream-most compressor bodies flows;

an inlet guide vane provided in a vicinity of an inlet of each of the plurality of upstream-most compressor bodies and configured to control a flow rate of the gas flowing in the corresponding upstream-most compressor body;

a plurality of upstream-most flow rate detectors provided in the vicinity of the inlets or outlets of the plurality of upstream-most compressor bodies and configured to generate upstream-most flow rate detection values by detecting flow rates flowing through the corresponding upstream-most compressor bodies;

a post-merger pressure detector configured to generate a post-merger pressure detection value by detecting a post-merger pressure of the gas flowing out from each of the plurality of upstream-most compressor bodies; and an outlet pressure detector configured to generate an outlet pressure detection value by detecting an outlet pressure of a downstream-most compressor body disposed furthest downstream among the at least one stage of downstream compressor bodies, the compressor control device comprising:

an inlet guide vane opening degree control unit configured to control an opening degree of the inlet guide vane, wherein the inlet guide vane opening degree control unit comprises:

an inlet guide vane opening degree command value generation unit configured to generate an inlet guide vane opening degree command value from the outlet pressure detection value; and a plurality of inlet guide vane opening degree command value correction units configured to correct the inlet guide vane opening degree command value based on the post-merger pressure detection value and the corresponding upstream-most flow rate detection value in each of the plurality of upstream-most compressor bodies, and wherein each inlet guide vane opening degree command value correction unit generates a flow rate estimation value based on the post-merger pressure detection value and an inlet guide vane opening degree detection value generated by an inlet guide vane opening degree detector included in the compressor to detect an opening degree of the inlet guide vane, each inlet guide vane opening degree command value correction unit generates an inlet guide vane opening degree command correction value based on a difference between the flow rate estimation value and the corresponding upstream-most flow rate detection value, each inlet guide vane opening degree command value correction unit corrects the inlet guide vane opening degree command value based on the inlet guide vane opening degree command correction value, and each inlet guide vane opening degree command value correction unit comprises a correction cancellation signal generation unit configured to output a signal to cancel the inlet guide vane opening degree correction value.

2. The compressor control device according to claim 1, wherein each inlet guide vane opening degree command value correction unit generates an inlet guide vane opening degree correction value by dividing the upstream-most flow rate detection value by the post-merger pressure detection value, and each inlet guide vane opening degree command value correction unit corrects the inlet guide vane opening degree command value based on the inlet guide vane opening degree command correction value.

3. The compressor control device according to claim 1, wherein each inlet guide vane opening degree command value correction unit comprises:

a performance difference correction coefficient generation unit configured to generate a performance difference correction coefficient indicating a difference in performance between the plurality of upstream-most compressor bodies; and an inlet flow rate target value generation unit configured to calculate an inlet flow rate target value based on the performance difference correction coefficient and the upstream-most flow rate detection value of each of the plurality of upstream-most compressor bodies, and each inlet guide vane opening degree command value correction unit calculates an inlet guide vane opening degree command correction value based on the inlet flow rate target value and the upstream-most flow rate detection value.

4. The compressor control device according to claim 1, further comprising:

a blowoff valve opening degree control unit configured to control an opening degree of a blowoff valve provided in a vicinity of an outlet of the downstream-most compressor body, wherein the blowoff valve opening degree control unit comprises:

an upstream anti-surge control unit configured to calculate a first blowoff valve opening degree command value based on the upstream-most flow rate detection value and the post-merger pressure detection value;

an outlet pressure control unit configured to calculate a second blowoff valve opening degree command value based on the outlet pressure detection value;

a downstream anti-surge control unit configured to calculate a third blowoff valve opening degree command value based on an outlet flow rate detection value and an outlet pressure detection value detected by an outlet flow rate detector provided in the vicinity of the outlet of the downstream-most compressor body; and a command value selection unit configured to control a blowoff valve opening degree by selecting a command value which has the largest opening degree of the blowoff valve among the first blowoff valve opening degree command value, the second blowoff valve opening degree command value, and the third blowoff valve opening degree command value.

5. The compressor control device according to claim 4, wherein the upstream anti-surge control unit calculates an inlet flow rate target value based on the post-merger pressure detection value and outputs the first blowoff valve opening degree command value by which the blowoff valve opening degree is controlled such that a flow rate in the inlet of the plurality of upstream-most compressor bodies becomes the inlet flow rate target value.

6. The compressor control device according to claim 4, wherein each blowoff valve opening degree command value is configured to have a smaller value as the opening degree of the blowoff valve to be commanded is larger, and the command value selection unit is a low selector configured to select a smallest value among the first blowoff valve opening degree command value, the second blowoff valve opening degree command value, and the third blowoff valve opening degree command value.

7. A compressor system comprising:

the compressor control device according to claim 1; and the compressor controlled by the compressor control device.

8. A compressor control method of controlling a compressor, the compressor comprising:

a plurality of upstream-most compressor bodies disposed furthest upstream;

an at least one stage of downstream compressor bodies which is disposed downstream from the plurality of upstream-most compressor bodies and in which a gas merged after outflow of gases from the plurality of upstream-most compressor bodies flows;

an inlet guide vane provided in a vicinity of an inlet of each of the plurality of upstream-most compressor bodies and configured to control a flow rate of the gas flowing in the corresponding upstream-most compressor body;

an inlet guide vane opening degree detector in the inlet guide vane, the inlet guide vane opening degree detector being configured to detect an opening degree of the inlet guide vane;

a plurality of upstream-most flow rate detectors provided in the vicinity of the inlets of the plurality of upstream-most compressor bodies and configured to generate upstream-most flow rate detection values by detecting inlet flow rates of the corresponding upstream-most compressor bodies;

a post-merger pressure detector configured to generate a post-merger pressure detection value by detecting a post-merger pressure of the gas flowing out from each of the plurality of upstream-most compressor bodies; and an outlet pressure detector configured to generate an outlet pressure detection value by detecting an outlet pressure of a downstream-most compressor body disposed furthest downstream among the at least one stage of downstream compressor bodies, the compressor control method comprising the steps of:

generating an inlet guide vane opening degree command value based on the outlet pressure detection value in an inlet guide vane opening degree control unit controlling an opening degree of the inlet guide vane;

generating a flow rate estimation value of each of the plurality of upstream-most compressor bodies based on the post-merger pressure detection value and an inlet guide vane opening degree detection value generated by the corresponding inlet guide vane opening degree detector;

generating an inlet guide vane opening degree command correction value for each of the plurality of upstream-most compressor bodies based on a difference between the corresponding flow rate estimation value and the corresponding upstream-most flow rate detection value;

correcting each inlet guide vane opening degree command value based on the inlet guide vane opening degree command correction value;

generating the inlet guide vane opening degree command correction value used to correct the inlet guide vane opening degree command value based on the post-merger pressure detection value and the corresponding upstream-most flow rate detection value in each of the plurality of upstream-most compressor bodies;

generating a signal to cancel the inlet guide vane opening degree command correction value; and selecting either one of 1) using the signal to cancel the inlet guide vane opening degree command correction value, or 2) correcting the inlet guide vane opening degree command value using the inlet guide vane opening degree command correction value.

* * * * *